US011267602B2

(12) United States Patent
Willis

(10) Patent No.: US 11,267,602 B2
(45) Date of Patent: Mar. 8, 2022

(54) REFUSE BAG INSERTION DEVICE AND METHOD

(71) Applicant: William Willis, Florence, SC (US)

(72) Inventor: William Willis, Florence, SC (US)

( * ) Notice: Subject to any disclaimer, the term of this patent is extended or adjusted under 35 U.S.C. 154(b) by 0 days.

(21) Appl. No.: 16/573,224

(22) Filed: Sep. 17, 2019

(65) Prior Publication Data

US 2020/0095002 A1 Mar. 26, 2020

Related U.S. Application Data

(60) Provisional application No. 62/733,723, filed on Sep. 20, 2018.

(51) Int. Cl.
*B65B 67/12* (2006.01)
*B65F 1/14* (2006.01)

(52) U.S. Cl.
CPC ..... *B65B 67/1238* (2013.01); *B65B 67/1205* (2013.01); *B65F 1/1415* (2013.01); *B65F 2240/138* (2013.01)

(58) Field of Classification Search
CPC ..... B65B 67/1238; B65B 67/1205; B65F 1/1415; B65F 2200/138
See application file for complete search history.

(56) References Cited

U.S. PATENT DOCUMENTS 1,879,410 A * 9/1932 Morris ..... B65D 25/16 493/480
2,264,200 A * 11/1941 Downs ..... A47F 7/06 211/33
3,822,524 A * 7/1974 Jerpbak ..... B65F 1/1415 53/459
3,915,329 A * 10/1975 Zaks ..... B65F 1/1415 141/390
4,014,157 A * 3/1977 Pearce ..... B65B 67/1238 53/459
4,457,483 A * 7/1984 Gagne ..... B65B 67/1205 141/316
4,628,007 A * 12/1986 Ledsham ..... B65D 33/02 141/390
4,890,652 A 1/1990 Hoerner
4,955,496 A 9/1990 Nelson
5,271,589 A 12/1993 Belous
5,372,269 A * 12/1994 Sutton ..... B65D 3/04 220/4.09
5,897,084 A * 4/1999 Judge ..... B65B 67/1205 141/390

(Continued)

*Primary Examiner* — Anita M King
(74) *Attorney, Agent, or Firm* — Boudwin Intellectual Property; Daniel Boudwin

(57) ABSTRACT

A refuse bag insertion device. The device is primarily formed by an elongated member. The elongated member has a first end and a second end. The first end includes a first fastener, while the second end includes a second fastener. The first fastener and the second fastener are complimentary to each other, so that the first fastener can be affixed to the second fastener, and vice versa. The elongated member is movable between a deployed position and a storage position. The deployed position is defined where the first fastener and the second fastener are engaged, such that a cylindrical housing is formed. One or more openings are placed through the elongated member. Each opening is dimensioned to receive a hand through the opening.

6 Claims, 2 Drawing Sheets

(56) References Cited

U.S. PATENT DOCUMENTS

| | | | | |
|---|---|---|---|---|
| 5,915,768 | A * | 6/1999 | Young | B65B 67/12 15/257.1 |
| 6,068,155 | A * | 5/2000 | Sicherman | B65B 67/1238 220/495.06 |
| 8,840,072 | B2 | 9/2014 | Muse | |
| 2010/0243650 | A1 | 9/2010 | Manley | |
| 2019/0016529 | A1 * | 1/2019 | Grace | B65F 1/1415 |

* cited by examiner

REFUSE BAG INSERTION DEVICE AND METHOD

CROSS REFERENCE TO RELATED APPLICATIONS

This application claims the benefit of U.S. Provisional Application No. 62/733,723 filed on Sep. 20, 2018. The above identified patent application is herein incorporated by reference in its entirety to provide continuity of disclosure.

BACKGROUND OF THE INVENTION

The present invention relates to a refuse bag insertion device. More specifically, the present invention relates to a device that can be inserted into a refuse bag in order to make placing refuse into the bag easier.

Yard work is an activity that can be a chore, a hobby or a job. Whether manicuring lawns, maintaining gardens or installing lawn fixtures, many people find themselves outside doing yard work of some nature. Regardless of an individual's opinion of yard work, however, it can be a physically exhausting activity. This is particularly true for elderly people or people with physical limitations.

When people are performing yard work, they typically engage is tasks such as mowing their lawn, raking leaves, removing twigs and sticks, pulling weeds and the like. As a result, grass clippings, dead leaves, falling branches, sticks, twigs, pulled weeds and other materials must be disposed of after they are removed. Typically, yard waste is placed into a refuse receptacle, such as a trash bag or a trash can. As yard materials are placed into such containers however, they expand and can be difficult to maneuver. Most notably, when using a trash can lined with a trash bag, the materials can expand the trash bag, causing it to get stuck in the trash can. This can make it very difficult to remove the trash bag from the trash can. As such, there is a defined need in the known arts for a device that will allow a user to more efficiently and effectively remove a trash bag from a trash can.

SUMMARY OF THE INVENTION

In view of the foregoing disadvantages inherent in the known types of refuse bag supports now present in the prior art, the present invention provides a refuse bag insertion device wherein the same can be utilized for providing convenience for the user when providing stable support to a refuse bag.

The present system comprises an elongated member. The elongated member has a first end that is disposed opposite of a second end. A first fastener is disposed on the first end of a front face of the elongated member. A second fastener is disposed on the second end of a rear face of the elongated member. The second fastener is complimentary to the first fastener, such that the second fastener and the first fastener can be engaged. A plurality of openings is disposed through the elongated member, proximate to a top edge or a bottom edge of the elongated member. The elongated member is movable between a deployed configuration and a storage configuration. The deployed configuration is defined where the first fastener is engaged with the second fastener, such that a cylindrical housing with an open upper end and an open lower end is formed.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
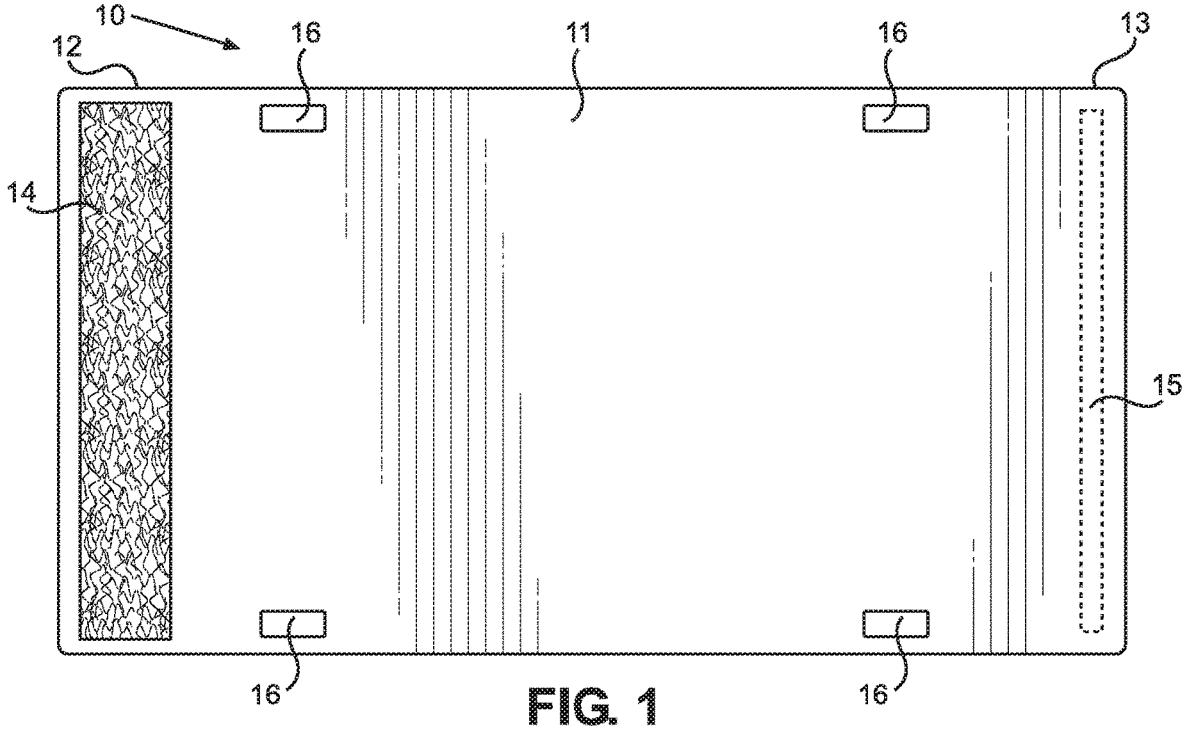
FIG. 1 shows a perspective view of an embodiment of the refuse bag insertion device in a storage configuration.

Reference is made herein to the attached drawings. Like reference numerals are used throughout the drawings to depict like or similar elements of the XXX. The figures are intended for representative purposes only and should not be considered to be limiting in any respect.

Referring now to FIG. 1, there is shown a perspective view of an embodiment of the refuse bag insertion device in a storage configuration. The refuse bag insertion device 10 comprises an elongated member 11. The elongated member 11 extends from a first end 12 to a second end 13. The elongated member 11 is made of a flexible material, such that an individual is able to bend and roll the elongated member 11. Furthermore, the elongated member 11 can be made from a non-porous, waterproof material, such that it will not absorbs odors or moisture and will not degrade as quickly from use. In one embodiment, the elongated member 11 is made of plastic.

A first fastener 14 is disposed on a front face of the first end 12 of the elongated member 11. A second fastener 15 is disposed on a rear face of the second end 13 of the elongated member 11. The second fastener 15 is complimentary to the first fastener 14, such that the first fastener 14 and the second fastener 15 can be held in a stable position when engaged with each other. In the illustrated embodiment, the first fastener 14 and the second fastener 15 define a hook and loop fastener. As such, the first fastener 14 and the second fastener 15 are freely and easily engageable and disengageable. In alternate embodiments, the first fastener 14 and the second fastener 15 are of any additional and suitable fastener. For example, in alternate embodiments, the first fastener 14 and the second fastener 15 define snap fasteners, a tab and tab receiver fastener, or a pair of ties configured to be tied together.

A plurality of openings 16 are disposed proximate to at least one edge of the elongated member 11. In the illustrated embodiment, the plurality of openings comprises a first pair of openings disposed proximate to a top edge of the elongated member 11, as well as a second pair of openings disposed proximate to a bottom edge of the elongated member 11. As such, the plurality of openings 16 will be accessible from an opening of a refuse receptacle, regardless of which edge of the elongated member 11 is inserted into the refuse receptacle.

The refuse bag insertion device 10 is movable between a deployed configuration (shown in FIGS. 2 and 3) and a storage configuration. The storage configuration is defined where the first end 12 of the elongated member 11 is extended away from the second end 13 of the elongated member 11, thus rendering the elongated member 11 as substantially planar in shape. As such, the refuse bag insertion device 10 may be more easily stored, as it can be rolled up, laid flat or placed against a wall.

Figure 2:
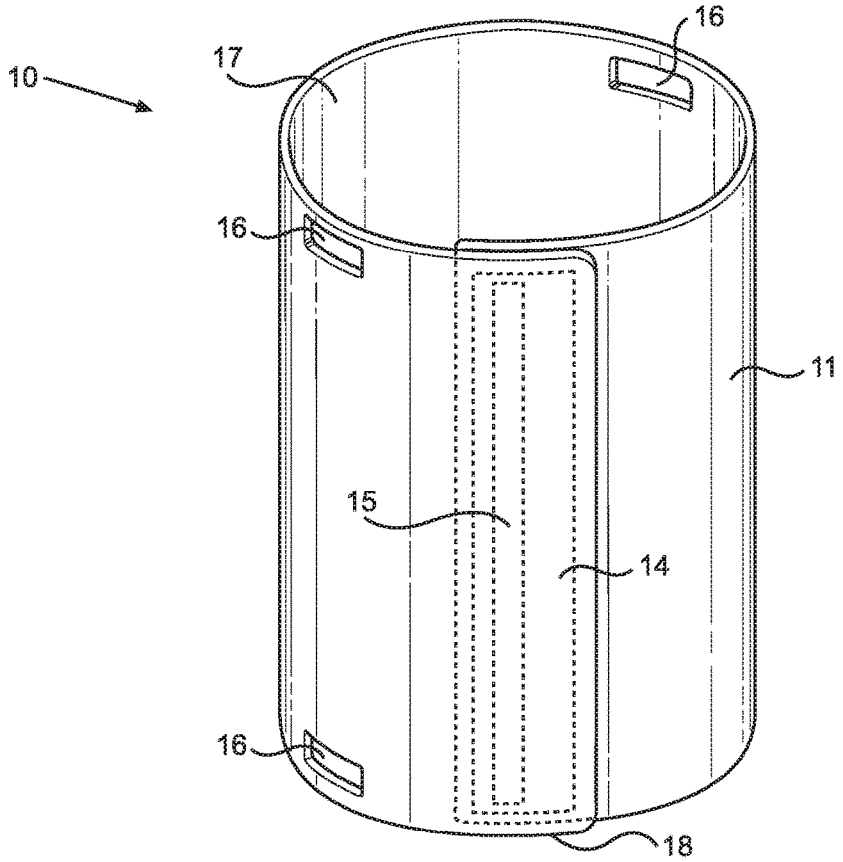
FIG. 2 shows a perspective view of an embodiment of the refuse bag insertion device in a deployed configuration.

Referring now to FIG. 2, there is shown a perspective view of an embodiment of the refuse bag insertion device in a deployed configuration. The deployed configuration, as shown, is defined where the first fastener 14 is engaged with the second fastener 15. As such, a cylindrical housing is formed. The elongated member 11 is dimensioned such that when the cylindrical housing is formed, it will fit into a refuse receptacle, such as a trash bag placed into a trash can.

When the elongated member 11 forms a cylindrical housing, the cylindrical housing defines an open upper end 17 opposite of an open lower end 18. As such a channel is formed between the open upper end 17 and the open lower end. The channel provides a means by which waste can be transported from the open upper end 17 to the open lower end 18. As such, when the refuse bag insertion device 10 is placed into a refuse receptacle, waste can be transported through the refuse bag insertion device into the refuse receptacle.

In the illustrated embodiment, the first fastener 14 is larger in size than the second fastener 15. As such, the diameter of the open upper end 17 is adjustable. An individual may wish to have a larger or smaller opening through which to access the open upper end 17. In other embodiments, the first fastener 14 is of an identical size to the second fastener 15, such that the first fastener 14 and the second fastener 15 are completely overlapping.

In some embodiments, the refuse bag insertion device 10 further comprises a lid. The lid may be removably disposed upon the open upper end 17 of the elongated member 11, when the elongated member 11 is in the deployed configuration. The lid is of any suitable configuration for securing to the elongated member 11. In a further embodiment, the lid comprises a lid handle. As such, the lid will be easier to remove from the open upper end 17.

In some embodiments, the plurality of openings 16 are disposed in symmetrical alignment when the elongated member 11 is in the deployed position, as shown. As such, an individual will be able to engage the pair of openings and applying equal force to each side of the elongated member. In the illustrated embodiment, the first pair of openings on the top edge of the elongated member 11 are in alignment with each other, as well as the second pair of openings on the bottom edge of the elongated member 11.

Figure 3:
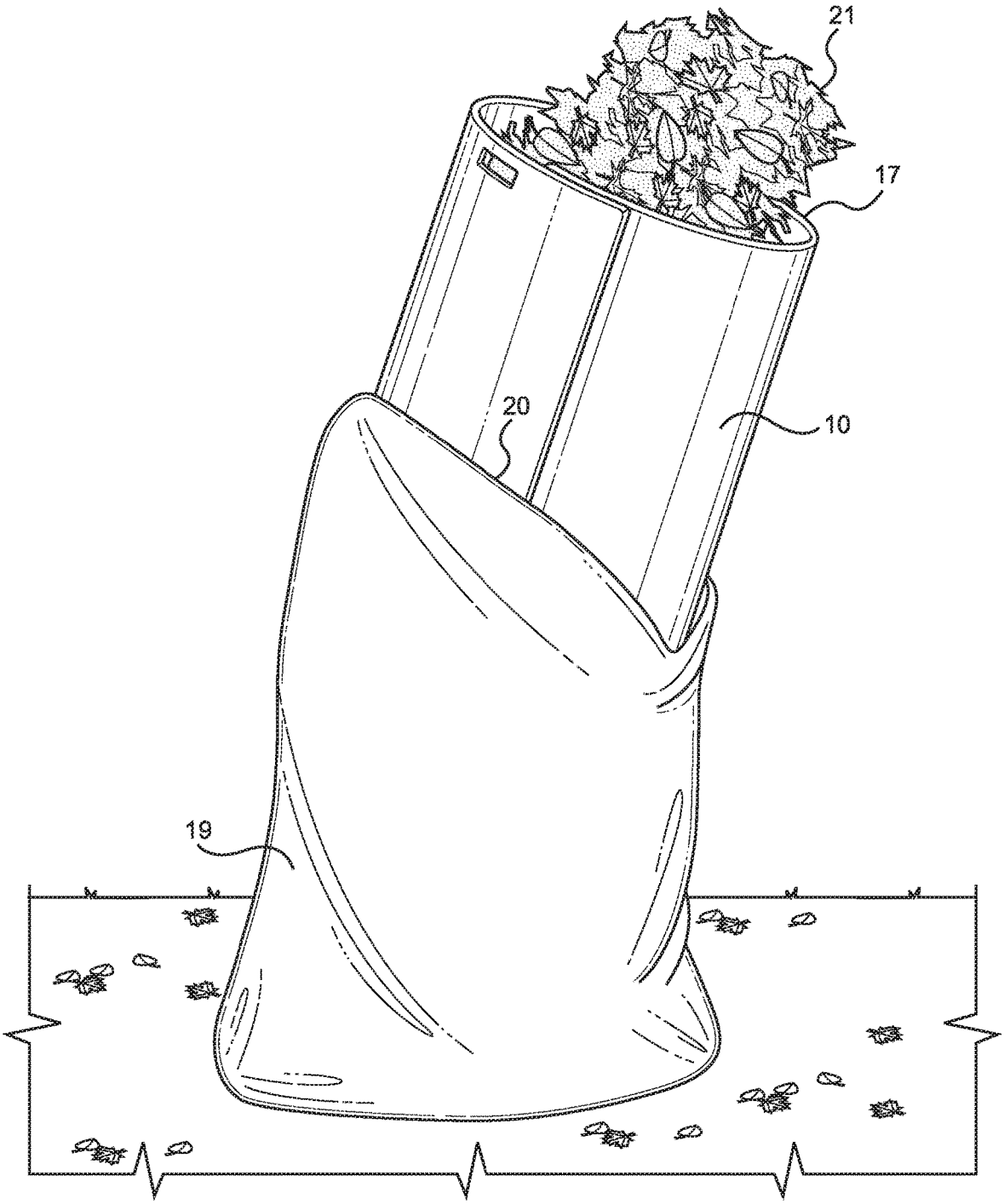
FIG. 3 shows a perspective view of an embodiment of the refuse bag insertion device in use.

Referring now to FIG. 3, there is shown a perspective view of an embodiment of the refuse bag insertion device in use. In use, the refuse bag insertion device 10 is placed into the deployed configuration by placing the first fastener into engagement with the second fastener. The refuse bag insertion device 10 is then placed into a refuse bag 19 at the mouth portion 20 of the refuse bag 19. The open upper end 17 of the refuse bag insertion device 10 extends from the mouth portion 20 of the refuse bag 19 when placed in the refuse bag 19. As such, refuse 21 can be placed into the open upper end 17 of the refuse bag insertion device 10, such that the refuse 21 can be stored in the body of the refuse bag 19. When the refuse bag 19 is full, the individual can then pull the refuse bag insertion device 10 from the mouth portion 20 of the refuse bag 19, allowing for the refuse bag 19 to be closed and disposed of.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refuse bag insertion device, comprising:

an elongated member;

the elongated member having a first end disposed oppositely a second end;

a first fastener disposed on the first end of a front face of the elongated member;

a second fastener disposed on the second end of a rear face of the elongated member;

the second fastener being complimentary to the first fastener;

wherein the first fastener is greater in width than the second fastener;

wherein the first fastener and the second fastener form a hook and loop fastener;

a plurality of upper openings disposed proximate to a top edge of the elongated member;

the elongated member movable between a deployed configuration and a storage configuration;

wherein the plurality of upper openings consists of a pair of upper openings that are disposed in linear alignment when the elongated member is in a deployed position;

wherein the deployed configuration is defined where the first fastener is engaged with the second fastener, such that a cylindrical housing with an open upper end and an open lower end is formed.

2. The refuse bag insertion device of claim 1, wherein the elongated member is made of a plastic material.

3. The refuse bag insertion device of claim 1, wherein the first fastener and the second fastener are identical in size.

4. The refuse bag insertion device of claim 1, further comprising a pair of lower openings that are disposed in linear alignment proximate to a bottom edge of the elongated member when the elongated member is in a deployed position.

5. A method of providing support to a refuse bag, the method comprising:

providing a refuse bag insertion device comprising an elongated member having a first end disposed oppositely a second end, a first fastener disposed on the first end of a front face of the elongated member, a second fastener disposed on the second end of a rear face of the elongated member, the second fastener being complimentary to the first fastener, wherein the first fastener is greater in width than the second fastener, wherein the first fastener and the second fastener form a hook and loop fastener, a plurality of upper openings disposed proximate to a top edge of the elongated member, wherein the plurality of upper openings consists of a pair of upper openings that are disposed in linear alignment when the elongated member is in a deployed position;

engaging the first fastener of the elongated member with the second fastener of the elongated member, forming a cylindrical housing with an open upper end;

inserting the cylindrical housing into a mouth of a refuse bag;

inserting refuse into the open upper end of the cylindrical housing;

removing the cylindrical housing from the mouth of the refuse bag.

6. A refuse bag insertion device, consisting of:

an elongated member;

the elongated member having a first end disposed oppositely a second end;

a first fastener disposed on the first end of a front face of the elongated member;

a second fastener disposed on the second end of a rear face of the elongated member;

the second fastener being complimentary to the first fastener;

wherein the first fastener is greater in width than the second fastener;

wherein the first fastener and the second fastener form a hook and loop fastener;

a plurality of upper openings disposed proximate to a top edge of the elongated member;

the elongated member movable between a deployed configuration and a storage configuration;

wherein the plurality of upper openings consists of a pair of upper openings that are disposed in linear alignment when the elongated member is in a deployed position;

wherein the deployed configuration is defined where the first fastener is engaged with the second fastener, such that a cylindrical housing with an open upper end and an open lower end is formed.

* * * * *